United States Patent [19]

Maw-Chyi

[11] Patent Number: 4,621,439

[45] Date of Patent: Nov. 11, 1986

[54] APPARATUS FOR SPEEDY DRYING

[76] Inventor: Chen Maw-Chyi, No. 68, Chiu She Rd., She Village, Hou Li Hsiang, Taichung, Hsien, Taiwan

[21] Appl. No.: 763,412

[22] Filed: Aug. 7, 1985

[51] Int. Cl.[4] ..... F26B 9/06

[52] U.S. Cl. ..... 34/92; 34/233; 417/76

[58] Field of Search ..... 34/233, 92, 84; 219/373; 417/76

[56] References Cited

U.S. PATENT DOCUMENTS

| | | | |
|---|---|---|---|
| 919,266 | 4/1909 | Tomlinson | 417/76 |
| 1,686,500 | 10/1928 | Whorff | 34/233 |
| 2,658,798 | 11/1953 | Meltzer et al. | 219/373 |
| 2,669,030 | 2/1954 | English et al. | 34/233 |
| 2,997,046 | 8/1961 | Doyle | 34/92 |

*Primary Examiner*—Larry I. Schwartz

*Attorney, Agent, or Firm*—Cushman, Darby & Cushman

[57] ABSTRACT

An improved drier including a closed container which has an outlet vapor port at its top side, a porous container for receiving the object to be dried, electric heating means for providing heat to the porous container, and a blower, a first conduit which has a venturi section, a second conduit of which one end is connected to the venturi section and the other end is connected to the vapor port. By the arrangement of the electric heating means, the blower and the venturi means, the object to be dried can be dried easily and quickly, thus saving the user's time and money.

1 Claim, 2 Drawing Figures

APPARATUS FOR SPEEDY DRYING

BACKGROUND OF THE INVENTION

This invention relates to an improved drier, particularly it concerns improvements made on a drier which can vent the humid vapour quickly and dry the wet objects rapidly.

Many of the known designs of drier used today comprise a container and a heating means, using the heating means for providing heat to the container. This kind of drier still has the disadvantage that some humid vapour is left behind in the container and cannot be dried quickly, even with the installation of air outlets to vent the humid vapour. Therefore, the user tends to feel that using such a drier is wasting both time and money.

SUMMARY OF THE INVENTION

With the above disadvantages in mind, the general object of the invention is to provide an improved drier which is simple in construction and will overcome the deficiencies and disadvantages of the prior arrangements.

In order to achieve the foregoing objects as well as other incidental objects and advantages, the invention comprises a closed container having a compartment for receiving the object to be dried, an outlet vapour port at its top side and a plurality of perforations at the bottom side of the closed container. The compartment is formed by a porous container which is provided in the upper portion of the closed container. The porous container has at least one top opening for venting humid vapour to the outlet vapour port and a plurality of perforations at the side wall and bottom side of the porous container.

Electric heating means for providing heat to the compartment disposed in the lower portion of the closed container includes a plurality of looped electric heating tubes mounted at intervals on the side wall of the closed container and electrically interconnected in parallel.

The closed container further includes a funnel below the porous container for receiving liquid coming out from the perforations of the porous container.

An improved drier further includes means for drawing humid vapour out of the compartment. The means includes a first conduit, a venturi section, a second conduit connected to the venturi section and the outlet vapour port of the closed container, and incorporating a blower for blowing air into the first conduit.

By the arrangement of the blowers and the venturi section, when the air blows through the first conduit and the venturi section, the air pressure in the venturi section is much less than in any other portion of the first conduit so that the humid vapour being vented will come out more quickly from the closed container. The object to be dried in the porous container can then be dried rapidly, thus saving the user's time and money.

DETAILED DESCRIPTION OF THE PREFERRED EMBODIMENT

The following is a detailed description of the best presently contemplated emboiment of the invention. This description is not to be taken in a limiting sense, but is made merely for the purpose of illustrating the general principles of the invention.

Figure 1:
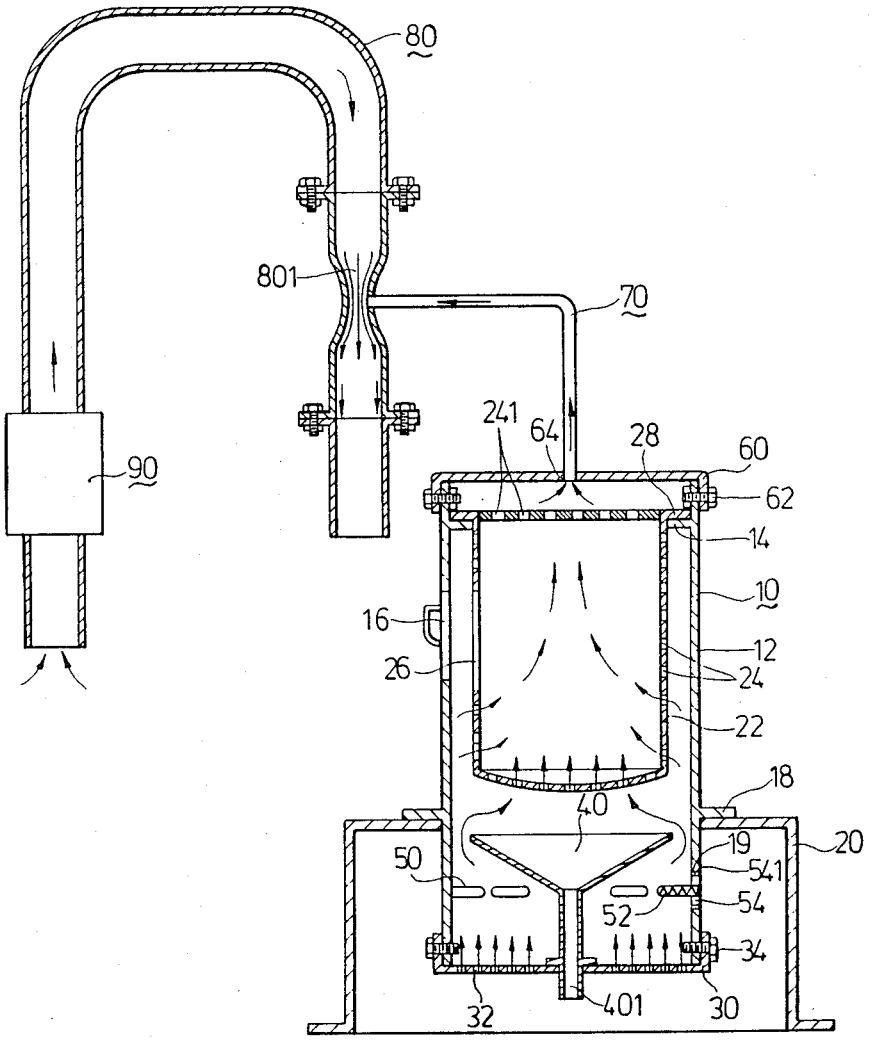
FIG. 1 is a side-section view of the preferred embodiment of an improved drier according to the invention.
Figure 2:
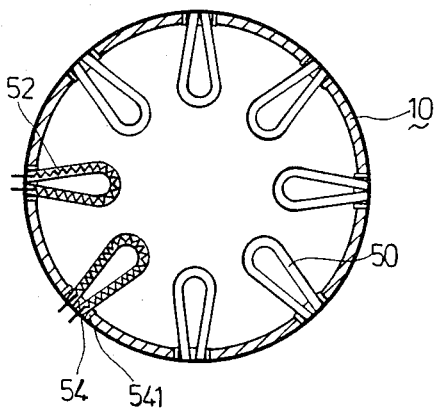
FIG. 2 is a top cross-sectional view of the electric heating means according to the invention.

Referring to FIG. 1 and FIG. 2, an improved drier includes a closed container 10, a first conduit 80, a second conduit 70 and a blower 90.

The closed container 10 is cylindrical and has an outer shell 12 which has a first annular protrusion 14 around the inner wall of the shell 12 at the upper portion of the closed container 10. The closed container 10 further includes a door 16 on the shell 12 and a second annular protrusion 18 on the outer wall of the shell 12 at the lower portion of the closed container 10. A plurality of screw holes 19 are provided under the second annular protrusion 18 on the shell 12. The second annular protrusion 18 of the closed container 10 can be placed on a predetermined number of legs 20 so that the closed container 10 can be stood firmly on the legs 20. A top cover 60, which has an outlet vapour port 64, covers the closed container 10 tightly, being held by screw 62. A bottom side 30 which has a plurality of perforations 32, is fixed to the closed container 10 by screw 34.

The closed container 10 further has a compartment for receiving the object to be dried, and the compartment is formed by a cylindrical porous container 22 which is provided in the upper portion of the closed container 10. The porous container 22 has at least one top opening 241 for venting humid vapour to the outlet vapour port 64 and a plurality of perforations 24 spread over its body and bottom side. The porous container 22 further has an opening 26 on the side wall and an annular flange 28 at its top side for setting the porous container 22 on the inner annular protrusion 14 of the closed container 10. The porous container 22 must be placed in a certain position in order to let the opening 26 of the porous container 22 face the door 16 of the closed container 10 so that by opening the door 16, the object to be dried can be put directly into the porous container 22.

Electric heating means 50 for providing heat to the compartment is disposed in the lower portion of the closed container 10 and includes a plurality of looped electric heating tubes 52 mounted on a connector device 54 which has a male screw thread 541 screwed into the screw hole 19 of the closed container 10 so that the the plurality of looped electric heating tubes 52 are mounted on the shell 12. The looped electric heating tubes 52 are electrically interconnected in parallel so that if one of the electric heating tubes 52 does not work, the remaining parts will not be affected. In addition, the number of looped electric heating tubes 52 being used at one time can be controlled in order to regulate the temperature according to the objects to be dried.

The closed container 10 still further includes a funnel 40 below the porous container 22 for receiving liquid coming out from the perforations 24 of the bottom side of the porous container 22 and the outlet 401 of the funnel 40 set at the middle of the bottom side 30 of the closed container 10. The funnel 40 is in an arrangement such that the funnel 40 is of wider dimension than the bottom side of the porous container 22 so that the liquid from the object to be dried can only drip down into the funnel 40.

An improved drier further includes means for drawing humid vapour from the compartment. The means includes the first conduit 80 incorporating a venturi section 801 and the blowers 90 for blowing air into the first conduit 80. The second conduit 70 is connected to the venturi section 801 and the outlet vapour port 64 of the closed container 10. The dimension of the first conduit 80 is larger than the dimension of the second conduit 70.

By the arrangement of the blower 90 and the venturi section 801, when the air blows through the first conduit 80 and the venturi section 801, the air pressure on the venturi section 801 is much less than in any other portion of the first conduit 80 so that the humid vapour being vented will come out more quickly from the other end of the first conduit 80. The faster the speed of the blower 90 blows the air into the first conduit 80, the quicker the object in the compartment will dry out, thus saving the user's money and time.

While this invention has been described with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

I claim:

1. A dryer, comprising:

a closed container having a compartment for receiving an object to be dried and an outlet vapour port on a top side thereof, wherein said compartment is formed by a porous container which is provided in an upper portion of said closed container, said porous container having at least one top opening for venting humid vapour to said outlet vapour port and a plurality of first perforations on its body and bottom side, and said closed container further including a plurality of second perforations on the bottom side of said container and a funnel below said porous container for receiving liquid coming out from said first perforations;

electric heating means for providing heat to said compartment disposed in a lower portion of said closed container, including a plurality of looped electric heating tubes mounted on said closed container at intervals and electrically interconnected in parallel;

means for controlling the number of said looped electric heating tubes being used at one time in order to regulate a temperature within said closed container according to the objects to be dried; and means for drawing humid vapour from said compartment, said drawings means including a first conduit, a venturi section, a second conduit connected to the middle portion of said venturi section and said outlet vapour port, and incorporating a blower for blowing air into said first conduit.

* * * * *